US005146781A

United States Patent [19]

Wilson et al.

[11] Patent Number: 5,146,781

[45] Date of Patent: Sep. 15, 1992

[54] TREATMENT OF METAL SLABS

[75] Inventors: Geoffrey Wilson; Timothy J. Bradshaw, both of Sheffield, England

[73] Assignee: Davy McKee (Sheffield) Limited, Sheffield, England

[21] Appl. No.: 659,350

[22] PCT Filed: Aug. 24, 1989

[86] PCT No.: PCT/GB89/00987

§ 371 Date: Feb. 19, 1991

§ 102(e) Date: Feb. 19, 1991

[87] PCT Pub. No.: WO90/02004

PCT Pub. Date: Mar. 8, 1990

[30] Foreign Application Priority Data

Aug. 26, 1988 [GB] United Kingdom ..... 8820296

[51] Int. Cl.[5] ..... B21B 15/00; B21B 39/24; B21D 31/06

[52] U.S. Cl. ..... 72/206; 72/231; 72/251; 72/373; 72/426; 164/424

[58] Field of Search ..... 29/527.7; 72/206, 227, 72/231, 251, 365.2, 372, 373, 375, 420, 426, 427, 404, 405, 189, 190; 164/417, 424, 476, 477, 480

[56] References Cited

U.S. PATENT DOCUMENTS

| | | | |
|---|---|---|---|
| 2,140,822 | 12/1938 | Tytus et al. | 72/231 |
| 3,333,452 | 8/1967 | Sendzimir | 164/476 |
| 3,340,716 | 9/1967 | Funk | 72/206 |
| 3,460,370 | 8/1969 | Kralowetz | 72/408 |
| 3,580,032 | 5/1971 | Stone et al. | 164/417 |
| 3,921,429 | 11/1975 | Sendzimir | 72/189 |
| 4,229,878 | 10/1980 | Ushijima | 29/527.7 |
| 4,387,586 | 6/1983 | Awazuhara et al. | 72/206 |
| 4,848,127 | 7/1989 | Isobe et al. | 72/206 |

FOREIGN PATENT DOCUMENTS

| | | | |
|---|---|---|---|
| 364590 | 10/1981 | Austria . | |
| 0089849 | 8/1978 | Japan | 72/206 |
| 0033001 | 2/1984 | Japan . | |
| 0199101 | 11/1984 | Japan . | |
| 0141301 | 7/1985 | Japan | 72/206 |
| 0067501 | 4/1986 | Japan . | |
| 0068645 | 3/1987 | Japan . | |
| 0081238 | 4/1987 | Japan | 72/206 |

*Primary Examiner*—Lowell A. Larson
*Assistant Examiner*—Thomas C. Schoeffler
*Attorney, Agent, or Firm*—Lee, Mann, Smith, McWilliams, Sweeney & Ohlson

[57] ABSTRACT

A method of treating hot metal slabs (6) aims to reduce the width of the slab (6) produced by a continuous casting process to avoid the need for the prolific number of moulds otherwise required to produce slabs of various widths. In order to achieve this the hot metal slab (6) is presented, with its width dimension vertically oriented, to a pressing machine (24) having a vertically movable top platen (26) and a fixed bottom platen (28). The slab (6) is incrementally displaced, longitudinally, through the pressing machine and pressing forces are applied to its opposing edges by the platens, to reduce its width. Subsequently, the slab (6) is turned so that its width dimension is oriented horizontally and rolled between the horizontal rolls of a rolling mill (22). An apparatus for performing the method is disclosed.

9 Claims, 3 Drawing Sheets

TREATMENT OF METAL SLABS

This invention relates to a method of, and apparatus for, reducing the width of a hot metal slab.

For the manufacture of metal strip, such as strip steel, it is becoming increasingly common to continuously cast a workpiece in the form of a slab, to cut the slab into lengths and to roll each length into strip. Because strips of different widths are required it is desirable that slabs of different widths should be available. If these slabs are to be cast in a continuous casting machine it is not convenient to have a number of moulds each representing a slab of different width. It is desirable, therefore, to cast slabs in a limited number of widths and, where necessary, to reduce the width of a slab to a predetermined value and to subsequently roll the slab into strip.

Japanese Patent Publication No. 59-199101 discloses apparatus for the aforesaid purposes.

According to the present invention, there is provided apparatus for reducing the width of a hot metal slab comprising:

means for presenting the slab to a pressing machine for applying forces to the edges of the slab and adapted to incrementally displace the slab forward after each application of the forces to reduce the width along its whole length, a rolling mill, and means for presenting the slab to the rolling mill subsequent to the width reduction, characterised in that the pressing machine is of vertically acting type and the slab is presented to the pressing machine with its width dimension vertical whereby the forces are applied to the top and bottom edges of the slab;

the means for presenting the slab to the pressing machine includes a press roller table, the means for presenting the slab to the rolling mill comprises a mill roller table and the press roller table and the mill roller table are arranged in parallel and a turning means is adapted to move the slab from the press roller table and deposit the slab on the mill roller table in a condition with its width dimension horizontal.

Further according to the present invention there is provided a method of reducing the width of a hot metal slab comprising the steps of:

moving the slab in the direction of its length, and presenting the slab to a pressing machine, applying forces to edges of the slab to reduce its width, incrementally displacing the slab in the direction of its length after each application of the forces to reduce the width of the slab along its whole length, and subsequent to the width reduction, rolling the slab in a rolling mill;

characterised by, presenting the slab to the pressing machine with its width dimension vertical, applying the forces to the top and bottom edges of the slab, turning the slab to a condition with its width dimension horizontal and displacing the slab in the direction perpendicular to its length, subsequent to the width reduction, to present the slab to the rolling mill by longitudinal displacement along a line parallel to the direction of displacement for presentation to the present machine.

By presenting the slab with its width dimension vertical to the pressing machine, a conventional vertically acting press can be employed to apply forces to the top and bottom edges of the slab in order to reduce the width dimension of the slab. Furthermore, it is possible for the pressing machine to have a fixed lower platen which engages with the lower edge of the slab and for a vertically reciprocating upper platen to engage with the upper edge of the slab. Such a pressing machine is simpler in construction than any pressing machine which would be required to act on the edges of the slab arranged with its width dimension horizontal.

Preferably the forces applied by the pressing machine area applied simultaneously over a substantial axial length, preferably at least equal to the original slab width. This enables the application of a pressing force sufficient to ensure that the stress field which causes deforming strains fully penetrates the width of the slab and avoids the formation of a dog bone cross-section in which the edges are thicker than the centre.

Normally the slab will be of much greater length than the region over which the forces are applied. For this reason the slab is incremented through the pressing machine so that its width is reduced stepwise along its length by repeated application of the forces. The thickening of the slab which accompanies each width reduction by the forces can produce a non-uniform cross-section if the increment is too long. This is undesirable and can be alleviated by reducing the increments to less than the length of the slab regions affected by each application of the forces.

Conveniently, a set of vertical pinch rolls are provided immediately upstream of the pressing machine in order to guide and increment the slab through the pressing machine.

Sets of tipping fingers are provided upstream of the pressing machine in order to turn a slab from a position in which its width dimension is horizontal to a position in which its width dimension is vertical and further tipping fingers are provided downstream of the pressing machine and upstream of the rolling mill in order to turn the reduced slab into a position which its width dimension is horizontal.

In order that the invention may be more readily understood, it will now be described by way of example only, with reference to the accompanying drawings, in which.

Figure 1A:
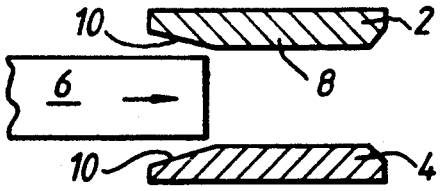
FIGS. 1A to 1G illustrate successive steps in reducing the width dimension of a metal slab;.

In FIG. 1, the platens 2, 4 of a pressing machine are shown acting upon a slab 6 moving in the direction of its length. Each platen has a generally horizontal portion 8 and an outwardly inclined portion 10 at the ingoing side of the press. Although both platens may be movable and reciprocated vertically towards and away from each other, it is more usual for the lower platen 4 to be fixed on the press housing and the upper platen 2 to be reciprocated towards and away from the fixed platen 4.

Figure 1B:
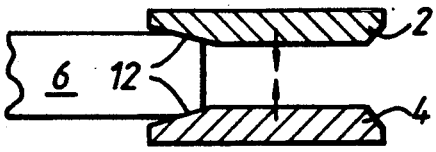
Figure 1C:
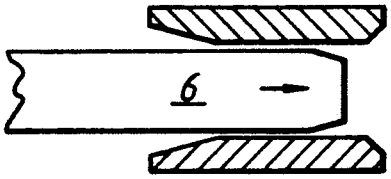
Figure 1D:
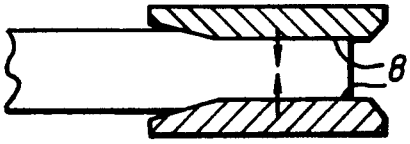
Figure 1E:
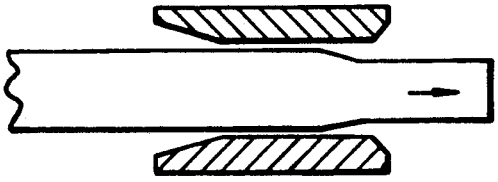
Figure 1F:
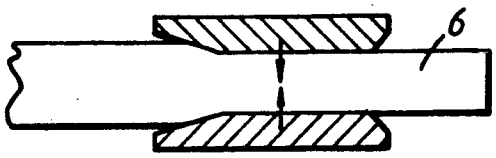
Figure 1G:
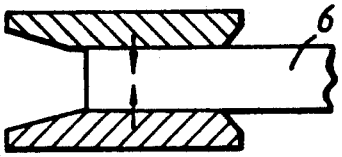

In FIG. 1A the platens are shown spaced apart and the leading end of the slab 6 is introduced between the platen. In FIG. 1B the upper platen 2 is urged towards the lower platen 4 and a taper 12 is formed on the leading head end of the slab. The platens are then opened to allow the slab to be incremented forward by a fixed distance to the position shown in FIG. 1C. The platens are then closed so that the portion 8 apply the required reduction to the slab as shown in FIG. 1D. Again, the platens are opened and the slab is incremented forward by a fixed amount to the position shown in FIG. 1E whereupon a further pressing operation takes place as shown in FIG. 1F. This sequence of operations is repeated until the upper and lower edges of the slab along the entire length of the slab have been pressed by the pressing machine to reduce the width dimension of the slab to the required value.

Figure 2:
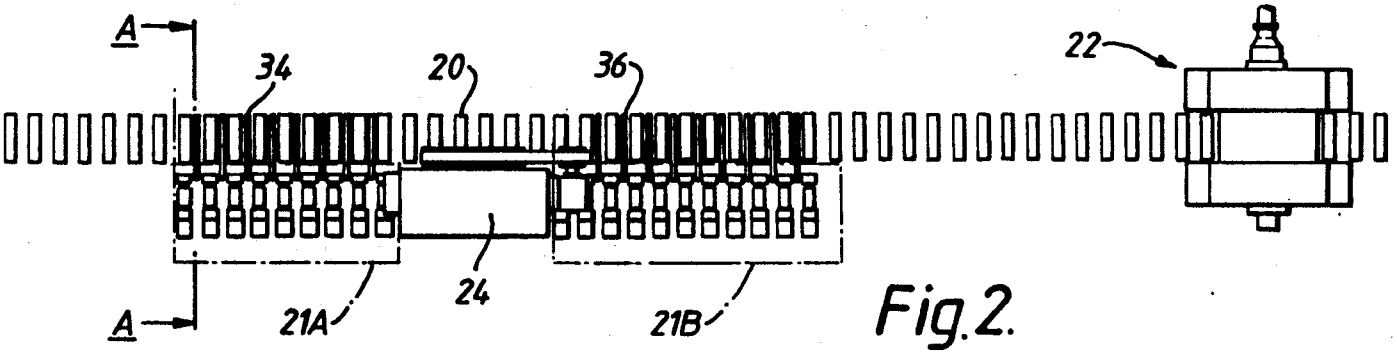
FIG. 2 is a plan of apparatus for reducing the width of a metal slab in accordance with one embodiment of the invention.
Figure 3:
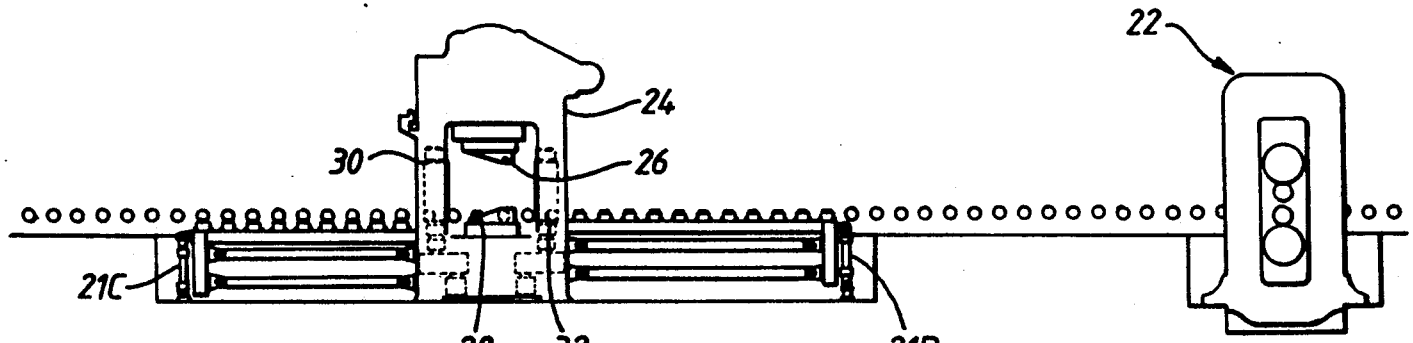
FIG. 3 is a side elevation of the apparatus shown in FIG 2.
Figure 4:
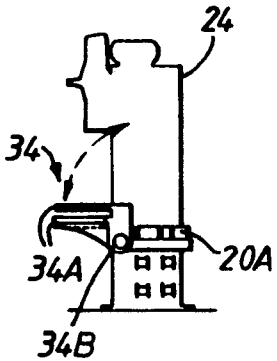
FIG. 4 is a diagrammatic section on the line A—A of FIG. 2.

Referring now to FIGS. 2, 3 and 4, apparatus is shown for carrying out the reduction in slab width referred to above and also to roll the slab after its width has been reduced. As shown in FIG. 2 the apparatus comprises a substantially conventional mill roller table 20 which leads to a conventional reversing roughing mill 22. Set off to one side of the table 20 is a press roller table 21 having a first part 21A and a second part 21B. The part 21A is arranged to support and supply a vertical slab to a pressing machine 24 from which it is withdrawn on the second part 21B. Both of the roller table parts 21A and 21B are supported upon hydraulic jacks 21C and 21D, respectively, to be independently height adjustable. Each of the roller table parts 21A, 21B is provided with independently operable tipping fingers 34 and 36, the form of which can best be seen in FIG. 4. It will be noted that the tipping fingers are each provided with two members 34A disposed to engage with respective opposite side of an edge of a slab. The tipping fingers 34 are mounted upon pivots 34B which are located beneath the roller table(s) to allow for convenient pivoting of the tipping fingers through a 90° angle, as shown by the arrows in FIG. 4. The tipping fingers 36 are similarly mounted.

In use, a slab is passed lengthwise down the mill roller table 20 with its width disposed horizontally. As the slab passes down the table one of its edges is received into the space between the members 34A of the tipping fingers. When the slab is adjacent the roller table part 21A it is stopped and actuators (not shown) rotate the tipping fingers 34 through 90° unitl the slab is arranged vertically on the first roller part 21A. The roller table part 21A is then operated to propel the slab down the table whereby the leading edge of the slab engages between two vertical pinch roller 30 which operate to guide the vertical slab between the opposing top and bottom platens 26 and 28, respectively. The platens 26, 28 apply width reducing forces to the opposing edges of the slab as described in detail above.

The slab is supported on the downstream side of the pressing machine 24 by two more vertical pinch rollers 32 and, as it exits from the pressing machine 24, by the second roller table part 21B and tipping fingers 36.

It will be realised that each application of the platens 26, 28 will produce a shoulder on the trailing edge of the platen and the resulting width reduction will cause the lower edge of the slab, on either side of the pressing machine 24, to be lowered by an amount approximately equal to half the width reduction. The hydraulic jacks 21C, 21D are, therefore, synchronously operated with the platen 28 to lower the slab by an appropriate amount and the subsequently raise the slab to allow it to be indexed forwards. As the width reduction is completed along the entire length of the slab it is discharged from the pressing machine 24 on to the roller table 21B.

Once the reduced width slab is discharged, the tipping fingers 36 are rotated to deposit the slab on to the mill roller table 20 for processing in the roughing mill 22. It will be noted that the location of the pressing machine 24 and the press roller table 21 in parallel with the mill roller table 20 allows for simultaneous pressing and roughing to take place.

Figure 5:
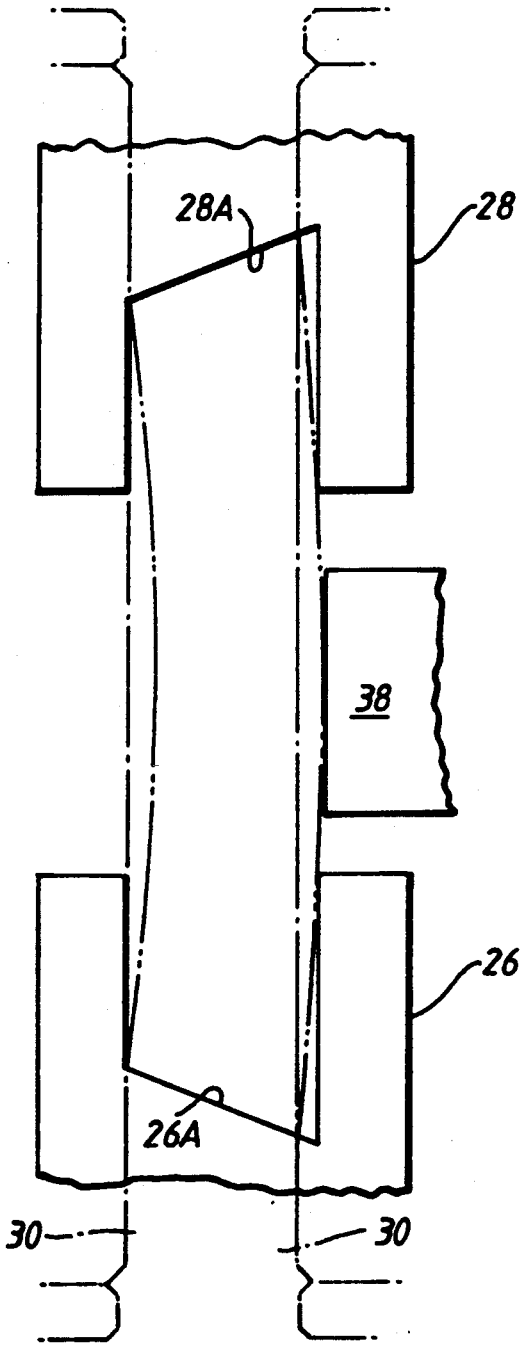
FIG. 5 shows an end on view of a slab passing through a pressing machine.

A problem may be encountered with the slabs buckling under certain circumstances. To alleviate this problem it is proposed, as shown in FIG. 5, that platens 26, 28 having opposing working surfaces 26A, 28A inclined in opposite directions will be used in combination with an anti-buckling support 38 which engages the slab on one side. The inclination of the working surfaces 26, 28 ensure that buckling will take place in one predetermined direction as shown in ghost lines. This is then conveniently constrained by the buckling support 38.

We claim:

1. Apparatus for reducing the width of a hot metal slab (6) comprising:

means for presenting the slab (6) to a pressing machine (24) for applying forces to the edges of the slab (6) and adapted to incrementally displace the slab (6) forward after each application of the forces to reduce the width along its whole length, a rolling mill (22), and means for presenting the slab (6) to the rolling mill (22) subsequent to the width reduction, in which the pressing machine (24) has vertically acting platens at least one of which is vertically movable whereby, when the slab (6) is presented to the pressing machine (24) with its width dimension vertical, the forces are applied to the top and bottom edges of the slab (6);

the means for presenting the slab (6) to the pressing machine (24) includes a press roller table (21), the means for presenting the slab (6) to the rolling mill (22) comprises a mill roller table (20) and the press roller table (21) and the mill roller table (20) are arranged in parallel and a turning means is adapted to move the slab (6) from the press roller table (21) and deposit the slab (6) on the mill roller table (20) in a condition with its width dimension horizontal.

2. Apparatus according to claim 1 wherein the pressing machine (24) comprises a vertically displaceable top platen (26) and a fixed bottom platen (28).

3. Apparatus according to claim 1 wherein the turning means is provided by tipping fingers (34, 36).

4. Apparatus according to claim 3 wherein the tipping fingers (34, 36) are each provided with two members (34A) disposed to engage with respective opposite sides of an edge of the slab (6).

5. Apparatus according to claim 1 wherein the means for presenting the slab (6) to the pressing machine (24) includes pinch rollers (30, 32) and the press roller table (21) is provided in first and second parts (21A, 21B) disposed upstream and downstream respectively of the pressing machine (24), and each roller table part (21A, 21B) is mounted on height adjusters for independent height adjustment.

6. Apparatus according to claim 5, wherein the turning means are arranged to transport the slab (6) from the second part (21B) of the press roller table (21) to the mill roller table (20).

7. Apparatus according to claim 5 wherein additional turning means are provided to transport the slab (6) from the mill roller table (20) to the first part (21A) of the press roller table (21).

8. A method of reducing the width of a hot metal slab comprising the steps of:

moving the slab in the direction of its length, and presenting the slab to a pressing machine, applying forces to edges of the slab to reduce its width, incrementally displacing the slab in the direction of its length after each application of the forces to reduce the width of the slab along its whole length, and subsequent to the width reduction, rolling the slab in a rolling mill;

characterised by, presenting the slab to the pressing machine with its width dimension vertical, applying the forces to the top and bottom edges of the slab, turning the slab to a condition with its width dimension horizontal and displacing the slab in the direction perpendicular to its length, subsequent to the width reduction, to present the slab to the rolling mill by longitudinal displacement along a line parallel to the direction of displacement for presentation to the pressing machine.

9. A method according to claim 8 wherein the forces are simultaneously applied along a length of the slab greater than or equal to its width.

* * * * *